US005181560A

United States Patent [19]

Burn

[11] Patent Number: 5,181,560

[45] Date of Patent: Jan. 26, 1993

[54] BAFFLELESS TUBE AND SHELL HEAT EXCHANGER HAVING FLUTED TUBES

[76] Inventor: Mark N. Burn, 1221 Tyler St., Port Townsend, Wash. 92368

[21] Appl. No.: 599,154

[22] Filed: Oct. 17, 1990

[51] Int. Cl.[5] ..... F28F 9/00

[52] U.S. Cl. ..... 165/162; 165/179; 165/177; 122/510

[58] Field of Search ..... 138/38; 165/158, 162, 165/179, 177; 122/510

[56] References Cited

U.S. PATENT DOCUMENTS

| | | | |
|---|---|---|---|
| 516,349 | 3/1894 | Hall | 165/158 |
| 770,599 | 9/1904 | Monteagle | 165/179 X |
| 2,362,694 | 11/1944 | Hill | 165/158 X |
| 2,928,528 | 3/1960 | Kelday et al. | 205/29 |
| 3,085,529 | 4/1963 | Admerand | 113/35 |
| 3,578,075 | 5/1971 | Winter | 165/177 |
| 3,612,175 | 10/1971 | Ford et al. | 165/179 |
| 3,713,323 | 1/1973 | Ivanier | 72/467 |
| 3,998,082 | 12/1976 | Mueller | 72/77 |
| 4,050,511 | 9/1977 | McDonald | 165/162 |
| 4,085,607 | 4/1978 | Muller | 72/77 |
| 4,132,264 | 1/1979 | Furlong | 165/179 |
| 4,215,559 | 8/1980 | Kuypers | 72/77 |
| 4,232,735 | 11/1980 | Kim et al. | 165/183 |
| 4,245,697 | 1/1981 | Togashi | 165/179 |
| 4,305,460 | 12/1981 | Yampolsky | 165/179 |
| 4,330,036 | 5/1982 | Satoh et al. | 165/179 |
| 4,377,083 | 3/1983 | Shepherd | 72/68 |
| 4,438,807 | 3/1984 | Mathur | 165/133 |
| 4,534,409 | 8/1985 | Cadars | 165/109.1 |
| 4,589,481 | 5/1986 | Mansson | 165/172 |
| 4,749,031 | 6/1988 | Fukumoto | 165/159 |
| 4,858,681 | 8/1989 | Sulzberger | 165/70 |
| 4,871,014 | 10/1989 | Sulzberger | 165/76 |

FOREIGN PATENT DOCUMENTS

| | | | |
|---|---|---|---|
| 877311 | 11/1981 | U.S.S.R. | 165/162 |

OTHER PUBLICATIONS

Turbotec "Selector Guide" pp. 1-4.
Turbotec "AquaSaver Refrigerant Condenser" pp. 1-4.
Turbotec Brochure No. CHE 87-07.0 pp. 1-4.
Turbotec Model: 3BTSSC-60VM pp. 1-2.
Turbotec "Process Flow Diagram" (Bulletin AR-S-CA) pp. 1-2.
Turbotec Model: 4BTSSC-60HM pp. 1-2.
Turbotec "All New Corrugated Tubing" pp. 1-2.
Turbotec Model: 5BTSSC-60HM pp. 1-2.
Turbotec "All Copper Desuperheaters" (CD87-0.70) pp. 1-2.
Turbotec "TurboVent" (TV87-07.0).
Turbotec Model: 2BTSSC-60VM, pp. 1-2.
Turbotec Model: 3BTSSC-60HM pp. 1-2.
Packless "Water Source Heat Pump Coils" pp. 1-13.
Packless "Chiller Coil Data Sheet" for Model No: CHAX-3100-H pp. 1-14.

*Primary Examiner*—Allen J. Flanigan
*Attorney, Agent, or Firm*—Seed and Berry

[57] ABSTRACT

A baffleless tube and shell heat exchanger for cooling a liquid, comprising a shell having an inlet and an outlet; a plurality of tubes longitudinally disposed in the shell, each of the tubes having an inlet and an outlet for passing a coolant therethrough, the liquid to be cooled passing through the shell along the exterior of the tubes, the interior and exterior circumference of the tubes being fluted substantially along the entire length thereof such that the coolant flows substantially longitudinally through the tubes in a spiralled manner and the liquid passes substantially longitudinally through the shell in a spiralled manner; and support means for supporting the tubes wherein the flow of the liquid through the heat exchanger only experiences restriction due to the tubes and the support means, there being no baffles to restrict the flow.

21 Claims, 5 Drawing Sheets

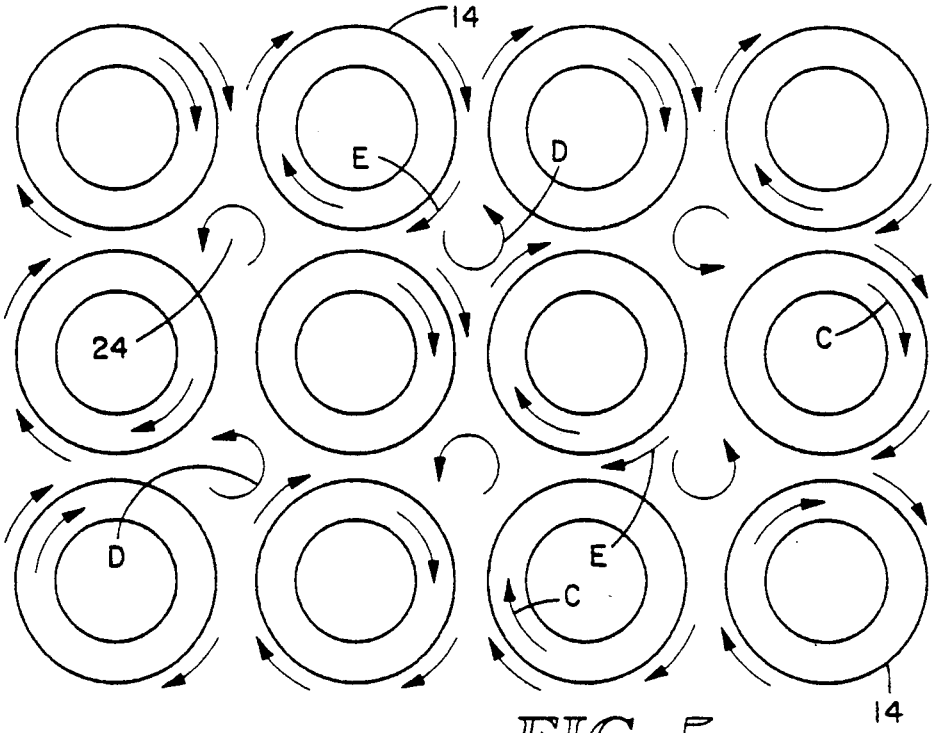
FIG. 5
FIG. 6
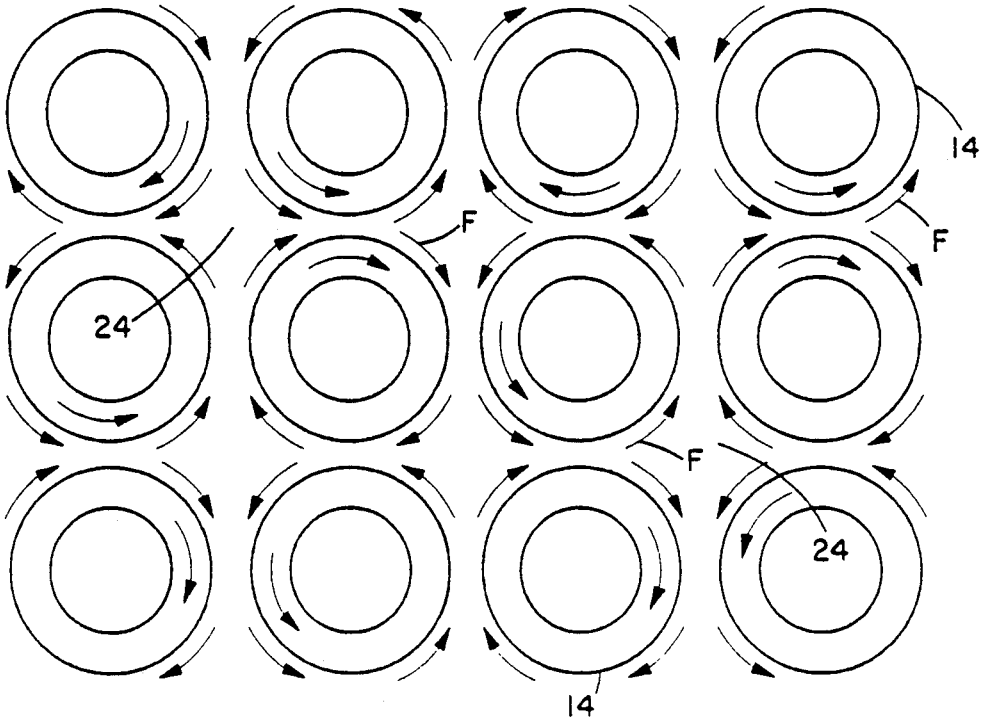

BAFFLELESS TUBE AND SHELL HEAT EXCHANGER HAVING FLUTED TUBES

TECHNICAL FIELD

This invention relates to a shell and tube heat exchanger and, more particularly, to a shell and tube heat exchanger having fluted tubes providing superior fluid flow characteristics without the need for baffles, the tubes being supported in such a manner as to minimize flow restriction.

BACKGROUND OF THE INVENTION

Shell and tube heat exchangers have been commonly used as the evaporator component for industrial air conditioning and refrigeration systems. A common usage of such systems is for chilling ocean water for storage and preservation of fish.

In such a system, in a vapor compression cycle, a liquified refrigerant is metered by a thermal expansion valve into the lower pressure environment of the heat exchanger. In the heat exchanger, the refrigerant changes phases from a liquid to a vapor as it absorbs the required heat from the liquid to be cooled. A compressor withdraws the refrigerant vapor from the heat exchanger, raises its pressure and discharges the refrigerant into the condenser, where the heat absorbed in the evaporator is discarded to the heat sink as the refrigerant changes phase from a vapor to a liquid. The higher pressure liquid is then ready for another cycle.

A common type of heat exchanger is a shell and tube heat exchanger which includes a shell having a plurality of tubes disposed therein. Refrigerant flows through the tubes while the fluid to be cooled flows through the shell, externally to the tubes and in contact therewith. As the refrigerant passes through the tubes it evaporates, absorbing heat from the fluid being cooled.

Laminar fluid flow through and along the exterior surface of the tubes is undesirable as it creates an insulating boundary layer contacting the tubes, thereby decreasing the amount of heat that is transferred from the fluid to the refrigerant. To overcome this problem, conventional tube and shell heat exchangers have utilized baffles spaced along the length of the shell and oriented so as to direct the fluid flow substantially along a sinusoidal path such that the fluid flows across the tubes thereby creating turbulence. For instance, U.S. Pat. No. 4,699,211, issued to Geary et al., and U.S. Pat. No. 4,118,944, issued to Lord et. al., disclose a shell and tube heat exchanger having a plurality of baffles spaced along the length of the shell for the purpose of creating a wave-like flow therethrough.

The problem associated with these conventional baffled shell and tube heat exchangers is that the velocity of the fluid passing through the heat exchanger is variable, increasing as it passes by the baffles and decreasing between the baffles. Since heat exchangers are designed for specific flow rates, the changing flow rate associated with a baffled heat exchanger makes the design less efficient. In particular, a baffled heat exchanger must be designed to accommodate the higher flow rates associated with the fluid passing by the baffles. Therefore, the flow rate of the fluid is often below the optimum flow rate for which the heat exchanger is designed. Moreover, the baffle design requires that the tubing be spaced relatively far apart in order to allow adequate fluid flow by the baffles. Another design for accommodating fluid flow by the baffles is to not include tubing proximate the baffles, resulting in portions of the heat exchanger having no tubing, and, therefore, no heat exchange. Each of these designs results in a relatively large heat exchanger.

A further disadvantage associated with a baffled heat exchanger is that the fluid flow in the areas adjacent the baffles is relatively stagnant. Therefore, when ocean water or other contaminated fluid is being cooled, these portions of the heat exchanger become contaminated, thereby reducing the efficiency of the baffled heat exchanger.

SUMMARY OF THE INVENTION

The present invention is designed to overcome the problems noted above with respect to the baffled heat exchanger. In particular, the present invention resides in a baffleless tube and shell heat exchanger for cooling a liquid, comprising a shell having an inlet and an outlet; a plurality of tubes longitudinally disposed in the shell, each of the tubes having an inlet and an outlet for passing a coolant therethrough, the liquid to be cooled passing through the shell along the exterior of the tubes, the interior and exterior circumference of the tubes being fluted substantially along the entire length thereof such that the coolant flows substantially longitudinally through the tubes in a spiralled manner and the liquid passes substantially longitudinally through the shell in a spiralled manner; and support means for supporting the tubes wherein the flow of the liquid through the heat exchanger only experiences restriction due to the tubes and the support means, there being no baffles to restrict the flow.

According to the preferred embodiment of the invention, the flutes have a pitch ranging from 20° to 70°, preferably from 40° to 50°; a height ranging between 10% and 30% of the outside diameter of the fluted tubes, preferably between 12% and 25%; and a width ranging between 1% and 10% of the outside diameter of the fluted tubes, preferably between 2% and 7%. The tubes are arranged in a matrix manner, there being a plurality of rows of tubes and a plurality of columns of tubes. According to one embodiment of the invention, all of the tubes are fluted in the same direction. According to an alternative embodiment, adjacent tubes along each row and column are fluted in opposite directions with respect to one another.

The means for supporting the tubes includes a plurality of brackets which are attached to unfluted portions of the tubes. In particular, each of the brackets has a plurality of interconnected partially circular portions which respectively partially circumscribe the unfluted portion of the tubes, the outside diameter of the partially circular portions of the brackets being less than the maximum diameter of the flutes such that the brackets do not substantially restrict the flow of the fluid through the shell on the exterior of the tubes. Further, the inside diameter of the unfluted tubular portion is at least as large as the minimum inside diameter of the tubes.

These and other aspects of the invention will become evident upon reference to the following brief description of the attached drawings.

BRIEF DESCRIPTION OF THE DRAWINGS

FIGS. 5 and 6 are schematic views illustrating the liquid flow characteristics;

DETAILED DESCRIPTION OF THE INVENTION

Figure 1:
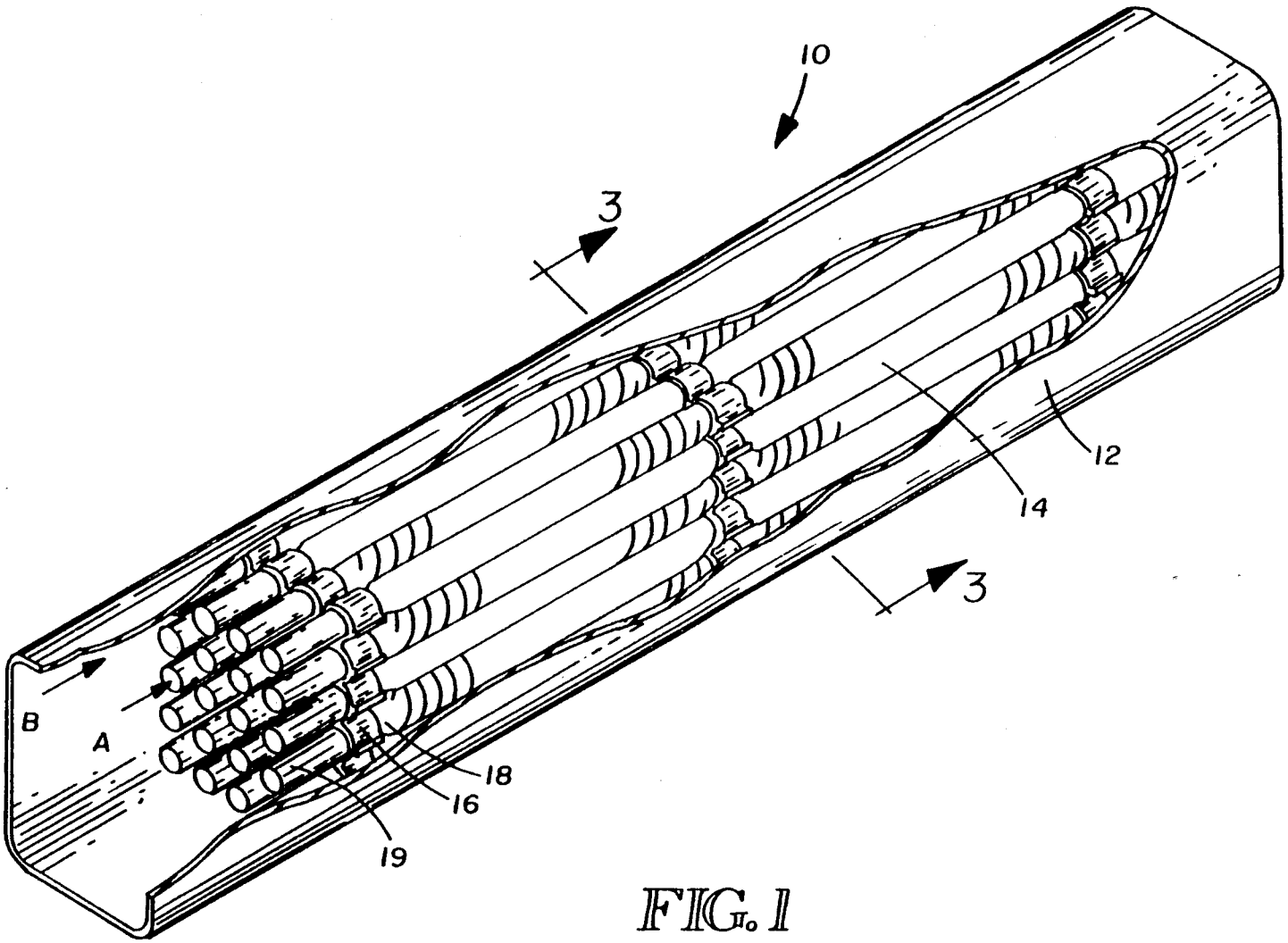
FIG. 1 is a perspective view of the tube and shell heat exchanger according to the present invention.

As noted above, the present invention is directed towards a baffleless tube and shell heat exchanger wherein the tubes are fluted to provide superior heat exchange characteristics. Referring to FIG. 1, the tube and shell heat exchanger 10 includes a shell 12 having a plurality of fluted tubes 14 longitudinally disposed therein and supported by brackets 16.

As described in detail below, according to a preferred embodiment of the invention, a coolant is circulated through the tubes, as illustrated by arrow A, and the liquid to be cooled is circulated through the shell on the exterior of the tubes, as illustrated by arrow B. Alternatively, the coolant can flow on the exterior of the tubes with the liquid to be cooled flowing through the tubes.

The tubes 14 are fluted substantially along the entire length of the tube and shell heat exchanger 10, except for areas 18 where the brackets 16 are secured to the tubes and areas 19 at the tube ends which are smooth for connection to the inlet and outlet manifolds, or the like. Of course, it is understood that the tubes could be fluted along the entire length utilizing alternative bracketing and manifold securing means. Typical flanges for enclosing the shell ends, and the inlet and outlet manifolds are not illustrated but would be well known to those skilled in the art.

Figure 2:
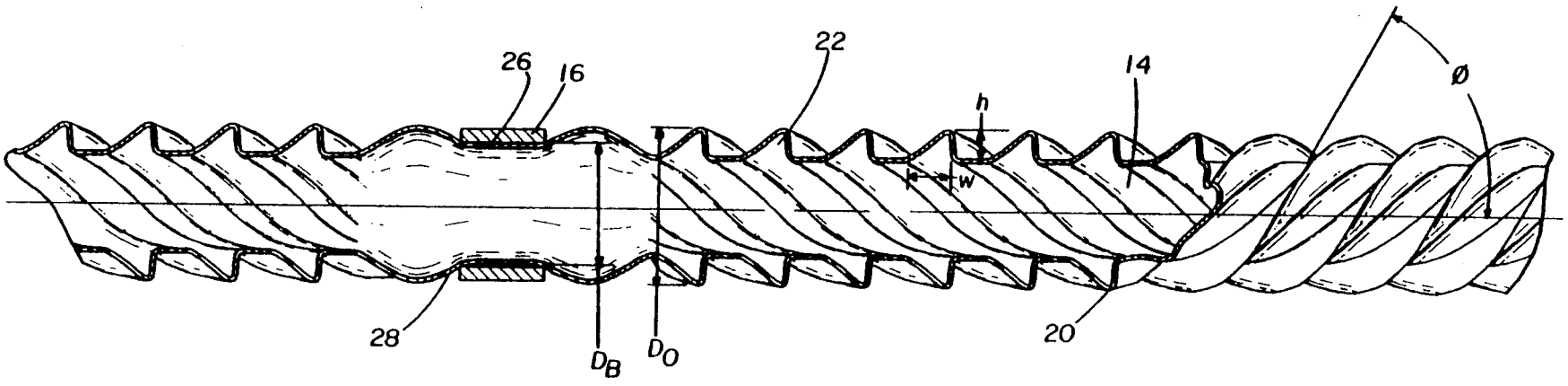
FIG. 2 is a cross-sectional side view of the tubes of the present invention.

Referring to FIG. 2, an important aspect of the tube design is that the flutes 20 are dimensioned to define spiralled cavities 22 through which the coolant can flow in a spiralled manner. Thus, according to a preferred embodiment, the height of each of the flutes is between 10% and 30%, preferably between 12% and 25%, of the outside diameter $D_o$ of the fluted tube; the average inside width W of each of the flutes is between 1% and 10%, preferably between 2% and 7%, of the outer diameter $D_o$ of the tube; and the pitch angle $\theta$ of the flutes is between 20° and 70°, preferably between 40° and 50°, as illustrated in FIG. 2. The number of flutes is preferably greater than three. Of course, it is understood that the invention is not to be limited in this regard.

The importance of the spiralled tube configuration having the flutes dimensioned as described above is as follows. It is commonly understood that the refrigerant passing through the tubes consists of a gaseous portion and a liquid portion. As explained above, the refrigerant absorbs heat from the liquid to be cooled when the refrigerant changes from the liquid phase to the gaseous phase. In order to optimize this energy exchange, it is important to maintain the liquid phase portion of the refrigerant in contact with the walls of the tubes where the heat exchange process takes place. Once the liquid portion of the refrigerant has been converted to gas, the gaseous portion of the refrigerant is no longer capable of absorbing any significant amount of heat from the fluid to be cooled and, therefore, provides little cooling effect.

The spiralled cavities 22 defined by the flutes dimensioned as described above causes the liquid phase portion of the refrigerant to flow through the tube in a spiralled manner. The centripetal force created by the refrigerants rotational flow separates the heavier liquid portion of the refrigerant out to the outer circumferential portion of the tube inside cavities 22, while the rotating gaseous portion continues to flow through the center portion of the tube. The velocity of the substantially separated liquid portion flowing within the cavity is slowed as compared to the gaseous core flow due to the frictional increase effect of the tube walls within the cavity 22, and the reduced shear force and area between the liquid and the higher velocity gas, as compared to a conventional tube. Due to the reduced shear force and area, the gaseous portion does not increase the flow rate of the liquid portion as much as the conventional tube arrangement. Therefore, as compared to the conventional design, the tube arrangement of the present invention results in a greater percentage of the liquid portion being disposed in the tube thereby improving the heat exchange capacity of the tube. Specifically, in the conventional tube arrangement, there is less retention of the liquid phase portion. Therefore, the liquid phase portion tends to exit the tube at a greater rate than in the tubes of the present invention.

Another advantage associated with this fluted design having the cavities 22 is that the surface area of the outer portion of the tube where heat exchange occurs is increased over conventional tube arrangements, the flutes 20 acting as fins to assist in the efficient transfer of the heat from the liquid to be cooled to the refrigerant. Since the liquid to be cooled contacts the fins on the exterior of the tube and the liquid portion of the refrigerant contacts the fins on the interior of the tube, heat exchange is maximized.

Another important aspect of the invention is that the tubing length can be reduced as compared to conventional tube design resulting in a more compact heat exchanger. First, due to the improved heat exchange efficiency, as discussed above, the tubes can be shortened and still provide the same cooling effect as the conventional tubes. The second reason relates to the requirement that the refrigerant must be in substantially the gaseous state when it exits the heat exchanger and enters the compressor. Conventional tube designs accomplish this by extending the length of the tubes so as to insure that most of the liquid portion of the refrigerant is evaporated into gas. It has been discovered that the added length required to convert substantially all of the liquid to gas is less for the present invention than the conventional design due to the continued contact of the liquid portion of the refrigerant with the two walls and the separation of the gaseous portion from the liquid, as discussed above. Since the liquid portion of the refrigerant is disposed primarily within the cavities 22, the liquid portion is protected from the higher velocity gaseous portion. Therefore, the amount of liquid droplets suspended in the gaseous flow is minimized.

Because of the reduced length of the tubing of the present invention, the pressure drop of the refrigerant passing through the tube is correspondingly reduced. In particular, since the tubes are shorter, the frictional effect on the refrigerant is less resulting in less pressure drop. The reduction in refrigerant pressure drop results in a more efficient heat exchanger.

Figure 4:
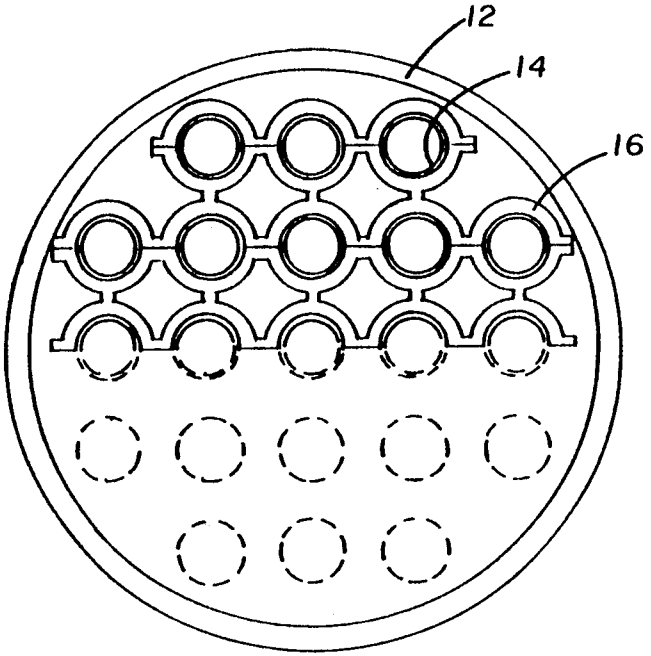
FIG. 4 is a cross-sectional view illustrating an alternative embodiment of the present invention.
Figure 3:
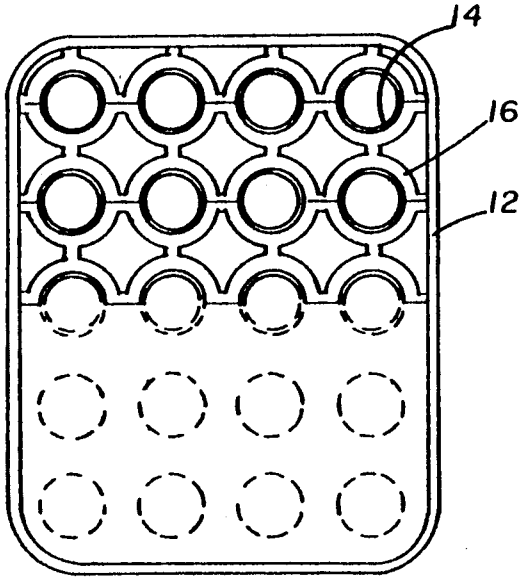
FIG. 3 is a cross-sectional view taken along line 3—3 of FIG. 1.

The fluted tube design of the present invention also provides superior external flow characteristics such that baffles are not required. In particular, FIGS. 3 and 4 illustrate the heat exchanger having a rectangular and circular cross sections, respectfully. As illustrated in these figures, the tubes are arranged in a matrix-like manner, including a plurality of aligned rows and columns with all of the tubes being fluted in the same direction. For the purpose of illustration, the flutes are right-handed, it being understood that all of the flutes could be left-handed. FIG. 5 illustrates the corresponding flow path of fluid to be cooled for such a configuration where all of the tubes are fluted in the same direction, as illustrated by arrows C. Referring thereto, the flutes 16 in the tubes 14 cause a portion of the liquid to circulate through the interstitial spaces 24 formed by each of the tubes in a substantially spiralled manner, as illustrated by arrows D in FIG. 5. On the other hand, a substream of the liquid flows from one interstitial space to another, as illustrated by arrows E. Thus, as can be seen from the foregoing, the spiralled flute design results in substantially random turbulence of the liquid due to the interaction between the spiralled stream and the substream as it flows through the tube and shell heat exchanger. As noted above, the importance of creating such turbulence is to prevent laminar flow of the fluid and corresponding inefficient heat exchange.

According to an alternate embodiment of the invention, adjacent tubes in the horizontal and vertical directions are fluted in opposite, left and right hand, directions. The resulting flow characteristics of such an arrangement is illustrated in FIG. 6. As illustrated therein, the resulting flow path of the liquid includes a primary stream flowing along the interstitial spaces 24 and substreams which continuously flow between the tubes from one interstitial space 24 to another as illustrated by arrows F. The resulting interchange between the primary streams and the substreams creates turbulence. Thus, such an arrangement also provides turbulent flow required for efficient heat exchange from the liquid to be cooled to the coolant.

It has been discovered that the flow created by the tube designs illustrated in FIGS. 4–7 provides sufficient turbulence of the liquid such that baffles are not required. Accordingly, the liquid can flow through the tube and shell heat exchanger at a substantially constant velocity subject to the turbulence (discussed above), thereby eliminating the flow rate problem discussed above with regard to the baffled tube and shell heat exchangers. Moreover, since there are no baffles, the entire interior of the shell experiences turbulent flow at a uniform flow rate, and therefore the entire tube and shell heat exchanger is continuously flushed. Accordingly, the heat exchanger is not likely to become as contaminated from ocean water, or the like, as is a baffled tube and shell heat exchanger having non-uniform flow, as discussed above.

The brackets are designed such that the space between the tubes, providing fluid flow path within the shell, can be adjusted to accommodate different flow volumes at optimum velocity by shortening or lengthening the interconnecting portion of the bracket, or utilizing the offset arrangement, discussed below, where the tubes are nested together, to reduce the flow path cross-sectional area to accommodate lower volume flow.

Figure 7:
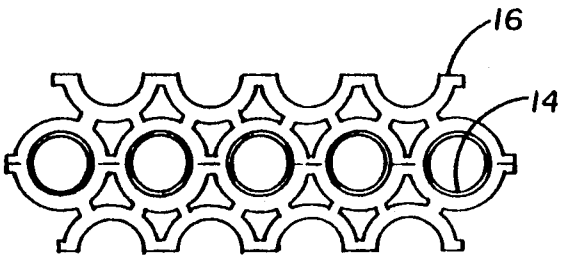
FIG. 7 is a front view of the bracket according to the present invention.

As noted above, in the embodiments illustrated in FIGS. 3 and 4, the tubes are arranged in a matrix, including a plurality of aligned rows and columns. According to another embodiment of the invention, the tubes can be arranged in an off-set matrix manner, resulting in a more compact design as illustrated in FIG. 7. In particular, referring thereto, the bracket 16 is designed to secure the tubes 14 in such a manner that adjacent rows are offset from one another in the horizontal direction such that the tubes in a column are nested midway between the tubes in adjacent columns. Such an arrangement results in more compact heat exchanger to accommodate lower flow volumes and yet maintain optimum flow rate and turbulence characteristics. The bracket design for supporting the tubes in this manner is illustrated in FIG. 7.

Figure 9:
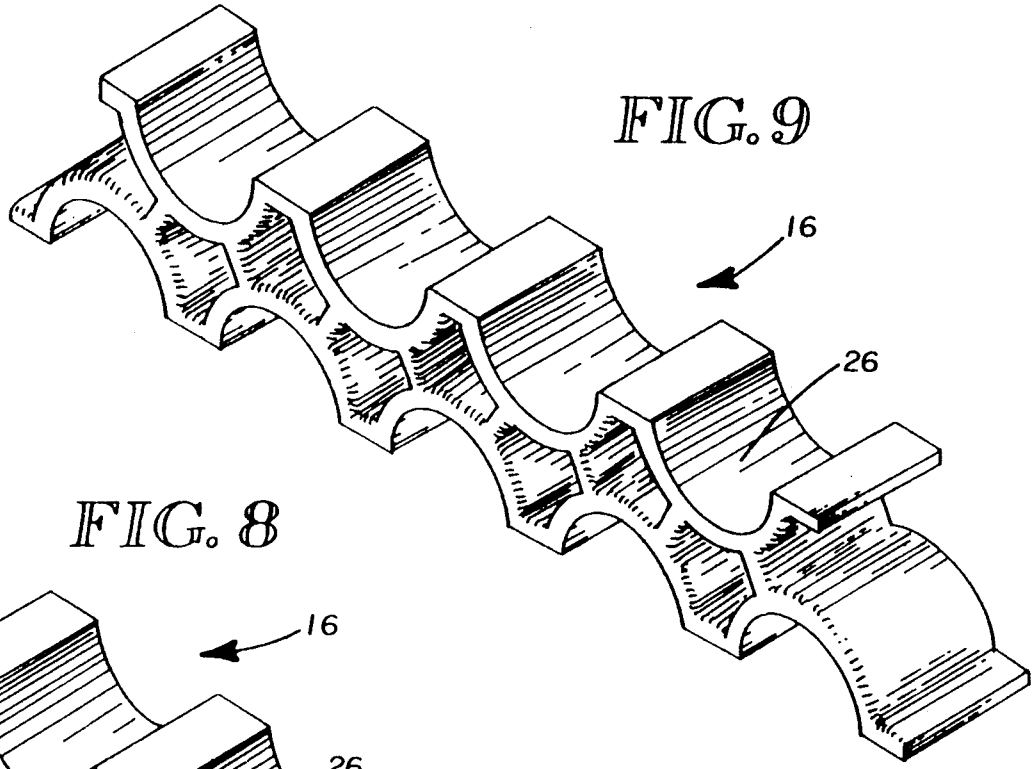
FIGS. 8 and 9 are perspective views of alternate bracket designs.
Figure 8:
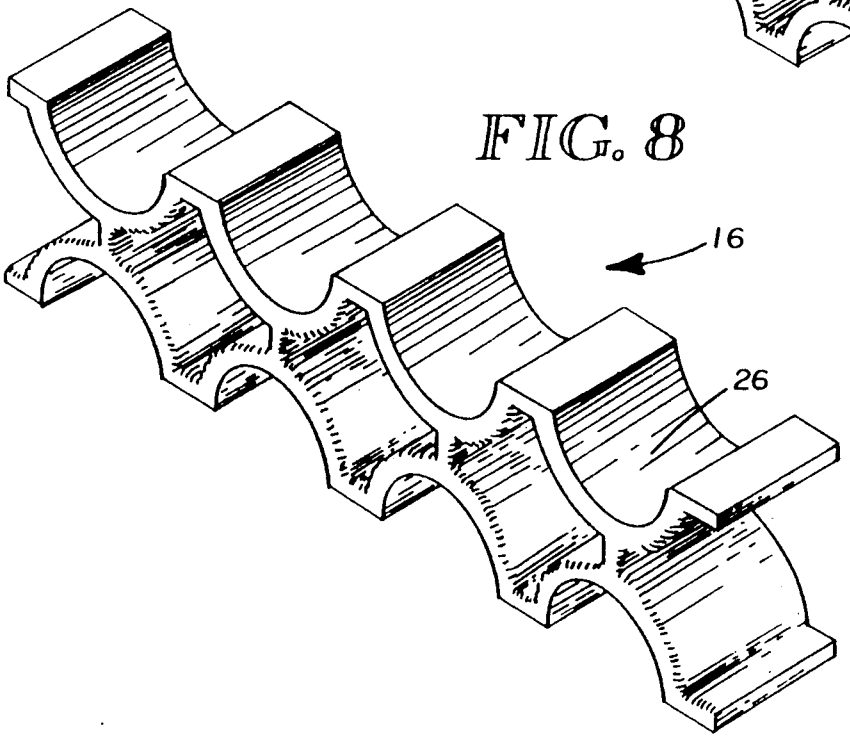

FIGS. 8 and 9 specifically illustrate the brackets 16 utilized for supporting each of the tubes 14 in the aligned and offset manners, respectively. Referring thereto, the bracket 16 includes a plurality of interconnected semicircular portions 26 upon which the tubes 14 are supported. The brackets 16 and tubes 14 are designed to minimize the amount of flow restriction of the liquid passing thereby. Referring also to FIG. 2, to accomplish this objective, the tubes have reduced diameter smooth tubular portions 28 to which the semicircular portions 26 of the brackets 16 are secured. In particular, the reduced diameter portion 28 has a reduced diameter which allows the bracket 16 to be attached thereto, with the outer diameter of the bracket $D_B$ being less than the outer diameter $D_0$ of the tube 14, as illustrated. In this manner, the semicircular portion 26 of the bracket 16 does not interfere with the flow of the liquid through the tube and shell heat exchanger. Thus, the only elements of the baffleless tube and shell heat exchanger of the present invention that restricts flow of the liquid to be cooled are the tubes and the small portion of the brackets that interconnect the semicircular portions 26. Further, according to a preferred embodiment of the invention, the inside diameter of the tubular portions $D_{ti}$ is no less than the inside diameter of the fluted portion $D_{fi}$ of the tubes such that the bracketing arrangement does not interfere with the flow of the coolant through the tubes.

The brackets can be manufactured out of cast metal, molded plastic or any other appropriate means and can be secured to each other by welding or other appropriate means. Further, the length and quantity of the brackets can be increased or decreased to accommodate the necessary amount of tubes.

It is understood that the tubes and the shell are manifolded to the supply and return lines for the coolant and liquid to be cooled, respectively, in the conventional manner. The ends of the tubes are not fluted to permit connection to conventional manifolds. It is also understood that the invention is not to be limited to a plurality of individual longitudinally-extending tubes. Rather, the invention could include a plurality of parallel tubes interconnected to one another.

While a preferred embodiment has been described, with respect to a refrigerant, it is understood that the refrigerant could be replaced by liquid coolant and still provide advantages over the prior heat exchanger design. For instance, the turbulence of the liquids inside and outside of the tubes due to the fluted design results in optimum heat exchanger. The turbulence is distributed evenly throughout the heat exchanger, as discussed above.

Experiments have shown that the resulting heat exchanger is superior to the conventional tube and shell heat exchanger. In particular, it has been discovered that the heat exchanger according to the present invention can be made ⅓ the size of the conventional heat exchanger and provide the same heat exchange effect. In the area of shipboard refrigeration systems for the preservation of fish, the reduced size of the heat exchanger of the present invention over the prior art provides a significant advantage.

As can be seen by the foregoing, the heat exchanger of the present invention is a relatively compact and efficient means for cooling a liquid, such as ocean water without experiencing adverse effects from contamination. It will be appreciated that, although specific embodiments of the inventions have been described herein for purpose of illustrations, various modifications may be without departing from the spirit and scope of the invention. Accordingly, the invention is not to be limited except as by the appended claims.

I claim:

1. A baffleless tube and shell heat exchanger for cooling a medium, comprising:

a shell having an inlet and an outlet;

a plurality of tubes longitudinally disposed on said shell, each of said tubes having an inlet and an outlet for passing one of a coolant and said medium therethrough, the other of said coolant and said medium passing through said shell along the exterior of said tubes, the interior and exterior circumference of said tubes being fluted substantially along the entire length thereof to define spiralled cavities at the periphery of a generally circular tube structure such that said one of said coolant and said medium flows substantially longitudinally through said tubes in a spiralled manner to force centripetally outwardly said one of said coolant and said medium into said spiralled cavities, said other of said coolant and said medium passes substantially longitudinally through said shell in a spiralled manner; and means for supporting said tubes intermittently positioned inside said shell between a first end and a second end of said shell wherein the flow of said other of said coolant and said medium through said heat exchanger only experiences restriction due to said tubeless and said support means, there being no baffles to restrict said flow, said means for supporting said tubes maintaining said tubes separate from one another so that there is no substantial contact between the tubes for support purposes said support means comprising a tube support structure having holes for receiving said tubes, and openings disposed between said holes permitting substantially unobstructed flow of said other of said coolant and said medium therethrough.

2. The heat exchanger of claim 1 wherein the height of each of said flutes is between 10% and 30% of an outside diameter of said fluted tubes.

3. The heat exchanger of claim 2 wherein the height of each of said flutes is between 12% and 25% of said outside diameter.

4. The heat exchanger of claim 2 wherein the width of each of said flutes is between 1% and 10% of said outer diameter.

5. The heat exchanger of claim 4 wherein the width of each of said flutes is between 2% and 7% of said outer diameter.

6. The heat exchanger of claim 4 wherein said flutes have a pitch angle between 20° and 70°.

7. The heat exchanger of claim 6 wherein said flutes have a pitch angle between 40° and 50°.

8. The heat exchanger of claim wherein said tubes are arranged in a matrix manner, there being a plurality of rows of tubes and a plurality of columns of tubes.

9. The heat exchanger of claim 8 wherein all of said tubes are fluted in the same direction.

10. The heat exchanger of claim 8 wherein adjacent tubes along each row and each column are fluted in opposite directions with respect to one another.

11. The heat exchanger of claim 8 wherein adjacent rows of tubes are aligned with one another.

12. The heat exchanger of claim 8 wherein adjacent rows of tubes are offset from one another.

13. The heat exchanger of claim 12 wherein said adjacent rows of tubes are offset from one another in the horizontal direction such that the tubes in a column are nested midway between tubes in adjacent columns.

14. The heat exchanger of claim 1 wherein said means for supporting said tubes space said tubes apart from one another a distance which corresponds to a length of said support means extending between said tubes and the flow rate of said other of said coolant and said medium is controlled by varying cross-sectional, peripheral dimensions of said shell and adjusting the length of said support means to change the distance between said tubes.

15. The heat exchanger of claim 1 wherein said tubes and said shell includes means for receiving a refrigerant coolant.

16. The heat exchanger of claim 1, wherein said support means can be varied by selecting a predetermined tube arrangement support structure to be utilized within a given shell structure to space the tubes at various distances relative to one another without any direct contact between the tubes.

17. The heat exchanger of claim 16 wherein the distance the tubes are spaced relative to one another is determined by a predetermined, optimum flow of one of said coolant and said medium through the shell of said heat exchanger between the tubes.

18. A baffleless tube and shell heat exchanger for cooling a liquid, comprising:

a shell having an inlet and an outlet;

a plurality of tubes longitudinally disposed in said shell, each of said tubes having an inlet and an outlet for passing one of a coolant and said liquid therethrough, the other of said coolant and said liquid passing through said shell along the exterior of said tubes, the interior and exterior circumference of said tubes being fluted substantially along the entire length thereof to define spiralled cavities therein such that said one of said coolant and said liquid flows substantially longitudinally through said tubes in a spiralled manner in said cavities and said other of said coolant and said liquid passes substantially longitudinally through said shell in a spiralled manner; and means for supporting said tubes wherein the flow of said other of said coolant and said liquid through said heat exchanger only experiences restriction due to said tubes and said support means, there being no baffles to restrict said flow, wherein each of said tubes has reduced diameter portion and wherein said tube supporting means comprises a plurality of brackets disposed in said shell for supporting said tubes, each of said brackets having a plurality of interconnected partially circular portions which respectively partially circumscribe said reduced diameter portion of said tubes, the diameter of said partially circular portions of said brackets being less than the maximum diameter of said flutes such that said brackets do not substantially restrict the flow of said fluid through said shell on the exterior of said tubes.

19. A baffleless tube and shell heat exchanger for cooling a liquid, comprising:

a shell having an inlet and an outlet;

a plurality of tubes longitudinally disposed in said shell, each of said tubes having an inlet and an outlet for passing one of a coolant and said liquid therethrough, the other of said coolant and said liquid passing through said shell along the exterior of said tubes, the interior and exterior circumference of said tubes being fluted substantially along the entire length thereof to define spiralled cavities therein such that said one of said coolant and said liquid flows substantially longitudinally through said tubes in a spiralled manner in said cavities and said other of said coolant and said liquid passes substantially longitudinally through said shell in a spiralled manner; and means for supporting said tubes wherein the flow of said other of said coolant and said liquid through said heat exchanger only experiences restriction due to said tubes and said support means, there being no baffles to restrict said flow, wherein each of said tubes has reduced diameter portion and wherein said tube supporting means comprises a plurality of brackets disposed in said shell for supporting said tubes, each of said brackets having a plurality of interconnected partially circular portions which respectively partially circumscribe said reduced diameter portion of said tubes, the diameter of said partially circular portions of said brackets being less than the maximum diameter of said flutes such that said brackets do not substantially restrict the flow of said fluid through said shell on the exterior of said tubes, wherein the inside diameter of said unfluted tubular portion is at least as large as the minimum inside diameter of said tubes.

20. A baffleless tube and shell heat exchanger for cooling a liquid, comprising:

a shell having an inlet and an outlet;

a plurality of tubes longitudinally disposed in said shell, each of said tubes having an inlet and an outlet for passing one of a coolant and said liquid therethrough, the other of said coolant and said liquid passing through said shell along the exterior of said tubes, the interior and exterior circumference of said tubes being fluted substantially along the entire length thereof to define spiralled cavities therein such that said one of said coolant and said liquid flows substantially longitudinally through said tubes in a spiralled manner in said cavities and said other of said coolant and said liquid passes substantially longitudinally through said shell in a spiralled manner; and means for supporting said tubes wherein the flow of said other of said coolant and said liquid through said heat exchanger only experiences restriction due to said tubes and said support means, there being no baffles to restrict said flow, wherein each of said tubes has reduced diameter portion and wherein said tube supporting means comprises a plurality of brackets disposed in said shell for supporting said tubes, each of said brackets having a plurality of interconnected partially circular portions which respectively partially circumscribe said reduced diameter portion of said tubes, the diameter of said partially circular portions of said brackets being less than the maximum diameter of said flutes such that said brackets do not substantially restrict the flow of said fluid through said shell on the exterior of said tubes, wherein said partially circular portions of said brackets are semicircular.

21. A baffleless tube and shell heat exchanger for cooling a liquid, comprising:

a shell having an inlet and an outlet;

a plurality of tubes longitudinally disposed in said shell, each of said tubes having an inlet and an outlet for passing one of a coolant and said liquid therethrough, the other of said coolant and said liquid passing through said shell along the exterior of said tubes, the interior and exterior circumference of said tubes being fluted substantially along the entire length thereof to define spiralled cavities therein such that said one of said coolant and said liquid flows substantially longitudinally through said tubes in a spiralled manner in said cavities and said other of said coolant and said liquid passes substantially longitudinally through said shell in a spiralled manner; and means for supporting said tubes wherein the flow of said other of said coolant and said liquid through said heat exchanger only experiences restriction due to said tubes and said support means, there being no baffles to restrict said flow, wherein said tube supporting means comprises a plurality of brackets disposed in said shell for supporting said tubes, each of said brackets having a plurality of interconnected partially circular portions which respectively partially circumscribe said reduced diameter portion of said tubes, the diameter of said partially circular portions of said brackets being less than the maximum diameter of said flutes such that said brackets do not substantially restrict the flow of said fluid through said shell on the exterior of said tubes, wherein said reduced diameter portion is not fluted.

* * * * *